United States Patent [19]

Jones et al.

[11] 3,964,899

[45] June 22, 1976

[54] ADDITIVES TO IMPROVE SLAG FORMATION IN STEELMAKING FURNACES

[75] Inventors: Evan Thomas Richard Jones; Robert Anthony Fishburn, both of Birmingham, England

[73] Assignee: Foseco International Limited, Birmingham, England

[22] Filed: Nov. 20, 1974

[21] Appl. No.: 525,668

[30] Foreign Application Priority Data

Dec. 12, 1973 United Kingdom ..... 57604/73

[52] U.S. Cl. ..... 75/53; 75/58; 75/94

[51] Int. Cl.[2] ..... C21C 7/00; C22B 9/10

[58] Field of Search ..... 75/53, 58, 94

[56] References Cited

UNITED STATES PATENTS

| | | | |
|---|---|---|---|
| 3,318,687 | 5/1967 | Bowden | 75/53 |
| 3,320,052 | 5/1967 | Bowden | 75/53 |
| 3,459,540 | 8/1969 | Tisdale | 75/53 |

*Primary Examiner*—Peter D. Rosenberg
*Attorney, Agent, or Firm*—Cushman, Darby & Cushman

[57] ABSTRACT

In steelmaking, the formation of a lime-based desulphurising slag is promoted by adding, with the lime, an additive including at least 20% by weight $Al_2O_3$ and including one or more of oxide of iron, magnesium, manganese and titanium, and melting below 1600°C.

18 Claims, 2 Drawing Figures

Depression of the melting-point of $2CaO.SiO_2$ by flux additions

Melting-points of 80% $2CaO \cdot SiO_2$ / 20% Additive Mixtures

ADDITIVES TO IMPROVE SLAG FORMATION IN STEELMAKING FURNACES

The present invention relates to the manufacture of steel and particularly to additives to be used in conjunction with lime to form a fluid basic slag during the refining of steel in the basic steelmaking processes.

In the manufacture of steel, by this process, impurities are removed from molten iron charged into a furnace by oxidation. (These impurities being principally silicon, manganese, carbon, phosphorus and sulphur). The oxides of the impurities, together with iron oxide formed during oxidation, rise to the surface of the melt and form a slag. It is well known that a highly basic slag (basicity being the so-called V-Ratio, the % CaO / % $SiO_2$ in the slag) is required for the removal of sulphur and phosphorus. In order to obtain a highly basic slag, large quantities of lime are added to the refining furnace.

In basic oxygen processes where 300 tons of steel can be produced in as short a time interval as 40 - 45 minutes, the steelmaking reactions are only fully active during the oxygen lancing period, which can last for as short as 16 minutes. The rate of refining is largely dependent on the speed with which a highly basic slag is formed, which is in turn dependent on the rate of dissolution of the lime. Slow slag formation is therefore the principal limitation that prevents the manufacturing cycle being further shortened.

In recent years, a great deal of attention has been directed towards resolving the optimum properties of lime in influencing its ability to form an early reactive slag. In general it has been shown that soft-burnt, reactive lime characterised by a fine particle size is superior to hard-burnt lime having a larger particle size in the form of coarse crystallites which impede its rapid assimilation into the slag. Although fine lime enters into the solution more rapidly there is a danger of losses to the atmosphere during the blowing period as well as a tendency to form large floating patches which prevent part of the remaining lime becoming available to the slag in the short lancing time that is used. One theoretical solution therefore appears to be to charge small lumps, large enough to remain as an individual entity in the slag but small enough to go rapidly into solution. It is apparent that if the lime is not rapidly dissolved, there is a danger of lime becoming hard-burnt in the furnace thereby further inhibiting its solution rate.

Lime has a high melting point (about 2,600°C) which is far above steelmaking temperatures (1,300°C to 1,400°C at the beginning of the lancing period). This implies that in order to dissolve lime in the slag, it must first react with one or more ingredients of the slag to form a lower melting point material, all of which requires time.

Another reason for the limited dissolution rate of lime in the slag is that particles of lime in the slag often react with silica forming a coating of dicalcium silicate (melting point about 2,100°C) around the lime particle. The early formation of this dicalcium silicate is highly detrimental since it forms a refractory coating around the lime particle, preventing it from going into solution and effectively deactivating it.

In order to overcome the slow dissolution of lime, fluxes, such as fluorspar and mill scale or lime in the form of diacalcium ferrite, are added to the slag. Although fluorspar is the most common fluxing agent for all basic furnace applications, there are increasing objections to its use on the grounds of environmental pollution. A further disadvantage is that the presence of fluorspar in a phosphoric acid-containing slag reduces it value as a fertiliser. In recent years, it is also apparent that the quantity and quality of available fluorspar for metallurgical use has diminished.

As well as increasing the time available for steelmaking reactions to occur, the rapid dissolution of lime will result in decreased attack on the basic refractory lining of the steelmaking furnace. Thus, when silicon becomes oxidised in the early part of a heat, the silica reacts readily with the magnesia in the lining (the refractory lining is commonly made of tar- or pitch-impregnated bricks high in dense magnesia which has been fired to over 1,600°C), and experience has shown that appreciable loss in basic refractory linings occurs during the first few minutes following the oxidation of the silicon.

According to the present invention there is provided a steelmaking additive comprising by weight at least 20% alumina, and including one or more of iron oxide, magnesium oxide, manganese oxide and titanium oxide and having a melting point of less than 1,600°C, preferably less than 1500°C. The additive is added with the lime to promote its dissolution. Preferably the one or more metal oxides selected from iron oxides, manganese oxide, magnesium oxide, and titanium oxide constitute 20–80% by weight of the fluxing additive, the remaining 80–20% by weight being alumina. The fluxing additive may if desired contain a small proportion, e.g. up to 20% by weight, of a fluidising agent such as fluorspar.

The use of such an additive, according to the present invention, gives an improvement in basic steelmaking technology by facilitating the rapid dissolution of lime in the slag, and hence giving shorter heat time. The lime rapidly dissolves to provide a fluid highly basic slag giving improved sulphur and phosphorus removal. Also refractory lining life is increased because the basicity of the slag is raised rapidly. The present invention includes both the improved steelmaking method and additives for fluxing lime in basic steelmaking.

By careful selection of mixtures of particular oxides with alumina, additives may be produced which give, with lime, mixtures which form slags at lower temperatures and faster than would be formed by mixtures of lime with any of the individual oxide materials alone.

The source of the alumina in the fluxing additive is preferably pit solids; this is a by-product formed in the production of aluminium. It consists mainly of $Al_2O_3$, usually from 50 to 80% by weight, but has a number of impurities, the exact amount and nature of which depend on the particular source of the pit solids. Generally, pit solids has a melting point of around 1,800°C. The impurities in the pit solids aid the production of an additive which melts at less than 1,500°C.

A typical analysis of a sample of pit solids is:

| Component | Weight % |
|---|---|
| $SiO_2$ | 5.8 |
| MgO | 6.6 |
| CaO | 3.6 |
| $Fe_2O_3$ | 1.5 |
| $Al_2O_3$ | 55.4 |
| Al (metal) | 2 |
| Al (as nitride) | 0.75 |
| $N_2$ | 0.39 |
| Cl | 1.9 |

-continued

| Component | Weight % |
|---|---|
| S | 0.14 |
| Ignition loss | 1.8% |

However, it should be emphasised that other pit solids samples may have a substantially different analysis (though still containing 50 – 80% by weight alumina) and still be useful in the present invention.

The specific types and quantities of other metal oxides in the fluxing additive are so selected as to give, with the alumina, a fluxing additive which will melt at less than 1,500°C; this promotes rapid reactions with the lime. The silica content of the additive should be as low as possible to minimise additional formation of dicalcium silicate and to give as high a basicity as possible in the slag. Although $Al_2O_3$ is an acidic oxide, it is generally considered to be far less acidic than silica and therefore affects the basicity only slightly.

The amount of additive to be used relative to the amount of lime used will vary with the particular steelmaking process in question, but it is generally in the range of 1 part by weight of additive per 5 to 15 parts by weight of lime.

The additive can be admixed with all or part of the lime charge. The additive can be added to the limestone prior to calcination or added to the calcined lime for subsequent briquetting. It is to be expected that the reactions between the lime and the fluxing additives will be more rapid in an intimate mixture than when the lime and flux are added to the furnace separately.

In the manufacture of the additives, the source of the oxides added to the pit solids may be a commercial raw material, rather than a chemically pure oxide. Thus mill scale may be used as a source of iron oxide, ilmenite as a source of titania and iron oxide and manganese ore as a source of manganese oxide.

The following Examples serve to illustrate the invention:

EXAMPLE 1 (COMPARISON)

The reactions between lime and fluxing materials were investigated by admixing lime and flux components in various proportions, forming these mixtures into 8 mm diameter tablets and heating the tablets in a 1 KW high frequency furnace. The tablets could be observed visually, and temperature measurements were made with an optical pyrometer. The melting points of various lime/flux mixtures are shown in Table 1:

TABLE 1

| Lime/Flux ratio (by weight) | 80/20 | 70/30 | 60/40 |
|---|---|---|---|
| Flux | | | |
| Fluorspar | 1700°C | 1650°C | 1550°C |
| Colemanite | 1700°C | 1650°C | 1400°C |
| Manganese ore | 1700°C | 1650°C | 1650°C |
| Pit Solids | 1650°C | 1435°C | 1400°C |

EXAMPLE 2

The procedure as described in Example 1 was carried out with multi-component flux additives according to the invention, and the results are given in Table 2:

TABLE 2

| Lime/Flux additive Ratio (by weight) | 80/20 | 70/30 | 60/40 |
|---|---|---|---|
| Flux | | | |
| Mixture A | 1675 | 1425 | 1345 |
| Mixture B | 1665 | 1400 | 1350 |
| Mixture C | 1650 | 1400 | 1375 |
| Mixture D | 1670 | 1450 | 1375 |

The analysed compositions of these flux mixtures A, B, C and D are given in Table 3 (in % by weight):

TABLE 3

| | $Al_2O_3$ | CaO | $TiO_2$ | $Fe_2O_3$ | $MnO_2$ | NgO | $SiO_2$ | F | Loss on ignition |
|---|---|---|---|---|---|---|---|---|---|
| Mixture A | 30.6 | 12.7 | 0.3 | 17.0 | 6.0 | 3.9 | 4.6 | 8.1 | 16.8 |
| Mixture B | 30.6 | 2.3 | 9.5 | 17.6 | 6.0 | 4.0 | 4.3 | 1.3 | 24.4 |
| Mixture C | 29.5 | 9.5 | 6.3 | 15.3 | 6.0 | 4.0 | 3.9 | 5.5 | 20.0 |
| Mixture D | 30.0 | 2.5 | 6.4 | 25.2 | 6.4 | 4.0 | 3.8 | 1.1 | 20.6 |

The actual composition of the flux additives was as follows:

| | Pit Solids | Ilmenite | Manganese ore | Fluorspar | Millscale |
|---|---|---|---|---|---|
| Mixture A | 60% | — | 10% | 15% | 15% |
| Mixture B | 60% | 20% | 10% | — | 10% |
| Mixture C | 60% | 10% | 10% | 10% | 10% |
| Mixture D | 60% | 10% | 10% | — | 20% |

As has been noted above, it is important for the flux additive to act on dicalcium silicate to form a low-melting point material in order to avoid refractory encasement of particles of lime. In this respect, the flux additives of the present invention are particularly useful.

Figure 1:
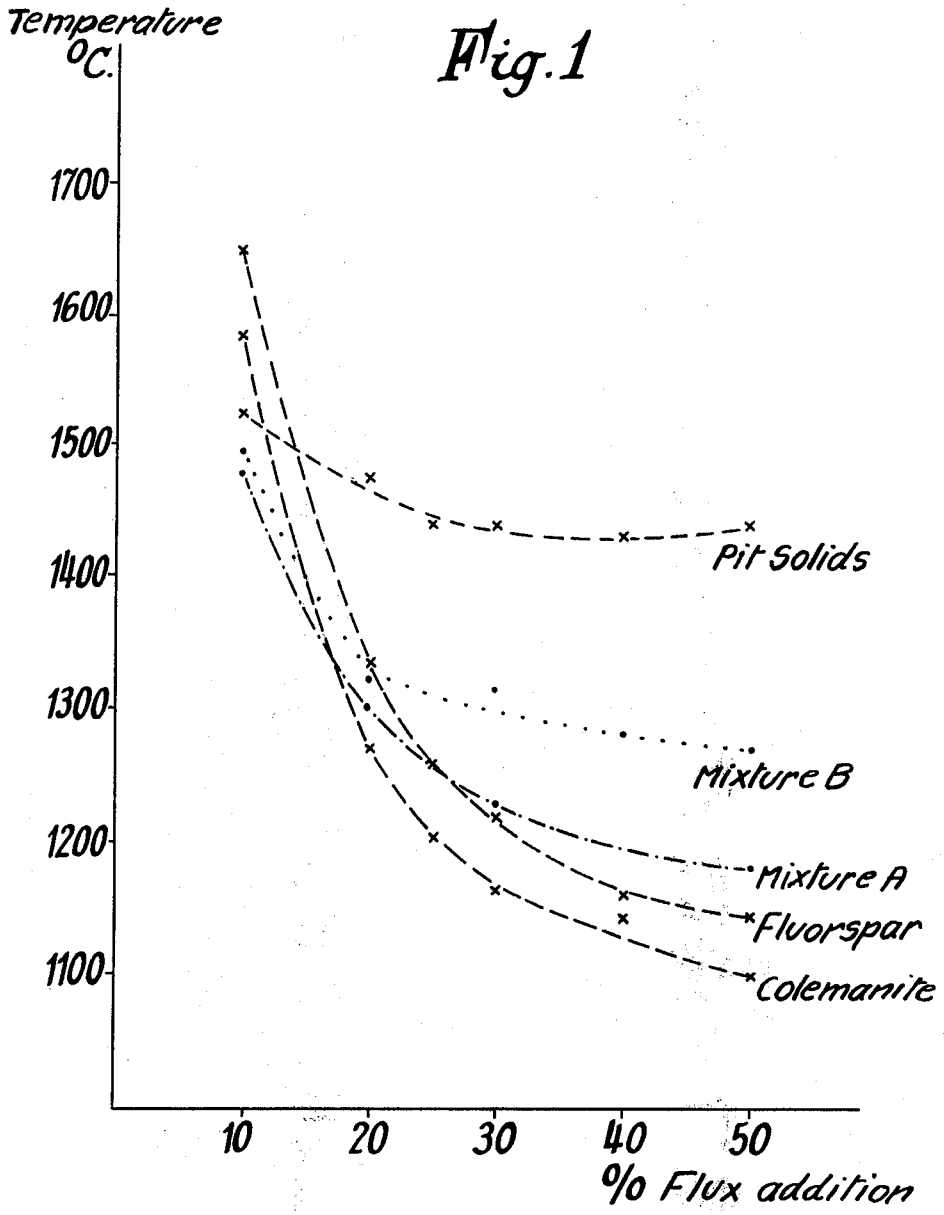
FIG. 1 is a graph showing the melting point of $2CaO.SiO_2$ + additive additions at various percentages of additive, for five different additives.

Referring to FIG. 1, it is clear that at low addition rates, mixtures A and B are more effective in fluxing away skins of $2CaO.SiO_2$ than are colemanite and fluorspar.

Figure 2:
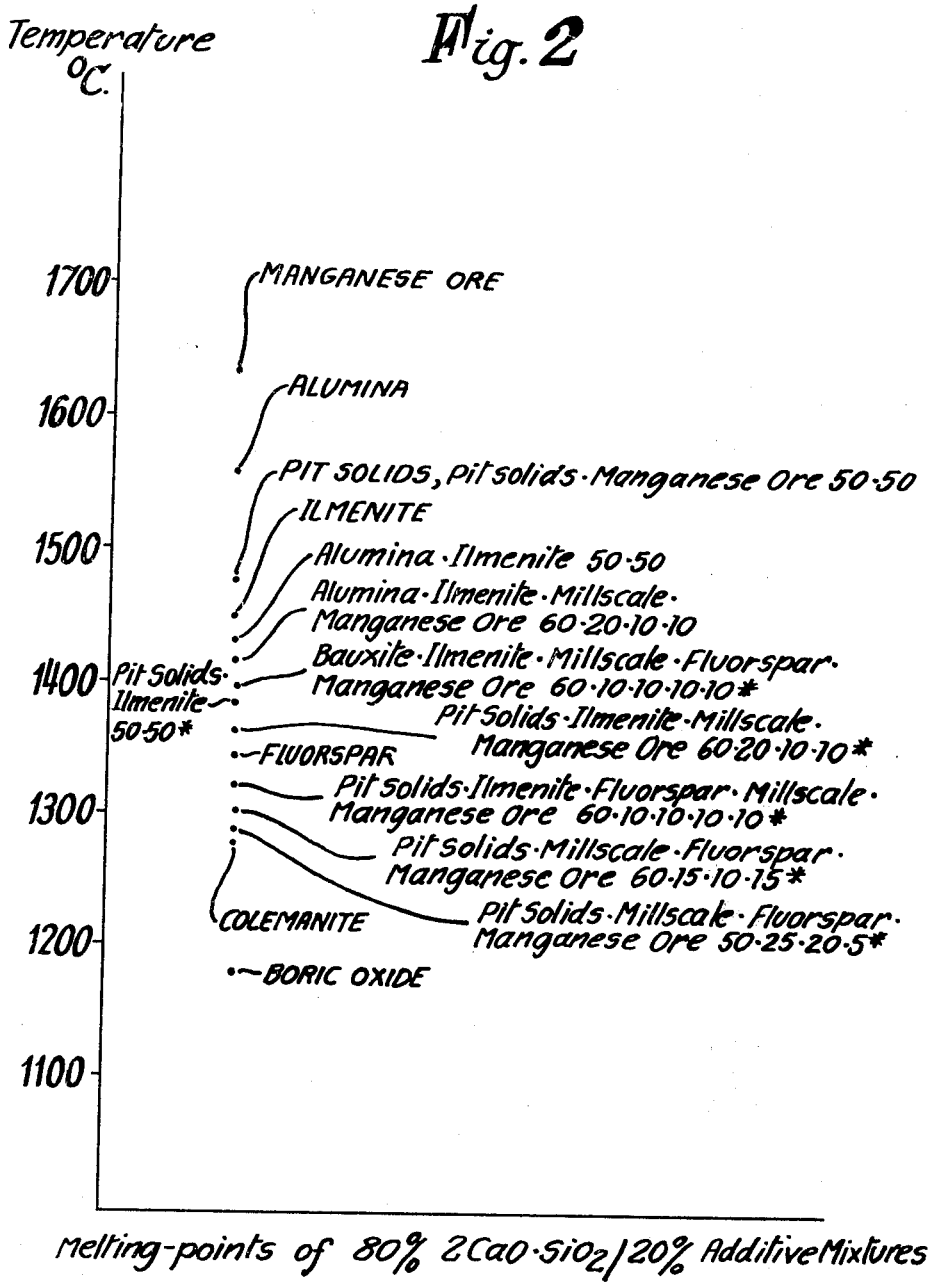
FIG. 2 is a plot of melting points of mixtures of 80% $2CaO.SiO_2$ + 20% additive for various additives.

Referring to FIG. 2, the additives according to the invention are marked with an asterisk.

We claim as our invention:

1. A composition for use in the refining of steel as a dry additive to be added with lime to promote dissolution of lime in slag, said additive being in essentially solid form and consisting essentially of, by weight, at least 20% alumina, and at least one oxide selected from the class consisting of iron oxide, magnesium oxide, manganese oxide and titanium oxide, the said additive having a melting point of less than 1600°C.

2. The additive of claim 1 and having a melting point of less than 1500°C.

3. The additive of claim 1 and including both iron oxide and manganese oxide.

4. The additive of claim 1 and including both iron oxide and magnesium oxide.

5. The additive of claim 1 and consisting to an extent of at least 50% by weight of pit solids.

6. The additive of claim 1 wherein the content of iron, magnesium, manganese and titanium oxides is in the range 20 – 80% by weight.

7. The additive of claim 1 and including up to 20% by weight fluorspar.

8. The additive of claim 1 and consisting essentially of a mixture of pit solids and at least one substance selected from the class consisting of millscale, manganese ore and ilmenite.

9. The additive of claim 1 in the form of a granulated composition.

10. The additive of claim 1 in the form of a tabletted composition.

11. The additive of claim 1 in the form of a briquetted composition.

12. A composition for use in the refining of steel as a dry additive to be added with lime to promote dissolution of lime in slag, said additive being in essentially solid form and consisting essentially of, by weight, at least 20% alumina, and at least one oxide selected from the class consisting of iron oxide, magnesium oxide, manganese oxide and titanium oxide, the said additive having a melting point of less than 1600°C and being in a form selected from the class consisting of granules, tablets and briquettes.

13. In the method of refining steel in which lime is added to the molten steel to effect the formation of a slag, the improvement which comprises adding with the lime, in order to promote slag formation, in essentially solid form consisting essentially of, by weight, at least 20% alumina, and at least one oxide selected from the class consisting of iron oxide, magnesium oxide, manganese oxide and titanium oxide, the said additive having a melting point of less than 1600°C.

14. The method of claim 13 wherein the weight ratio of additive to lime is from 1:5 to 1:15.

15. The method of claim 13 wherein prior to adding the additive and the lime to the molten steel, the additive and the lime are intimately admixed.

16. The additive of claim 1 consisting essentially of 20–80% by weight alumina and 80–20% by weight, at least one oxide selected from the class consisting of manganese dioxide and titanium dioxide.

17. The additive of claim 1 consisting essentially of 20–80% by weight alumina and 80–20% by weight of titanium dioxide, manganese dioxide, ferric oxide and magnesium oxide.

18. The additive of claim 1 consisting essentially of 20–80% by weight alumina and 80–20% by weight of at least one oxide selected from the class consisting of manganese dioxide and titanium dioxide and at least one oxide selected from the class consisting of iron oxide and magnesium oxide.

* * * * *